US005588786A

United States Patent [19]

House et al.

[11] Patent Number: 5,588,786

[45] Date of Patent: *Dec. 31, 1996

[54] COMBINATION RETAINING WALL AND METHOD OF CONSTRUCTION

[75] Inventors: Randall H. House; Johann H. Hofmann, both of San Antonio; Freddie C. Birck, Boerne, all of Tex.

[73] Assignee: Marylyn House, San Antonio, Tex

[ * ] Notice: The term of this patent shall not extend beyond the expiration date of Pat. No. 5,471,811.

[21] Appl. No.: 475,212

[22] Filed: Jun. 7, 1995

Related U.S. Application Data

[63] Continuation-in-part of Ser. No. 917,841, Jul. 21, 1992, Pat. No. 5,471,811, which is a continuation-in-part of Ser. No. 675,503, Mar. 26, 1991, and Ser. No. 601,413, Oct. 22, 1990, Pat. No. 5,131,786, which is a continuation-in-part of Ser. No. 347,482, May 4, 1989, Pat. No. 4,964,750.

[51] Int. Cl.[6] ..... E02D 5/10; E02D 29/02; E04B 2/00

[52] U.S. Cl. ..... 405/285; 405/258; 405/284; 405/286; 52/741.15; 52/169.9; 52/295; 52/438

[58] Field of Search ..... 405/284, 285, 405/286, 258, 262; 52/745.1, 745.13, 747.12, 437, 438, 442, 609, 579, 259, 295, 741.15, 169.9; 256/13.1, 19, 73

[56] References Cited

U.S. PATENT DOCUMENTS

| | | | |
|---|---|---|---|
| 1,739,108 | 12/1929 | Weber | 405/262 |
| 1,933,483 | 10/1933 | Pennoyer | 61/39 |
| 1,943,800 | 1/1934 | Morrison | 61/39 |
| 2,129,369 | 9/1938 | Faber | 52/438 |
| 2,963,827 | 12/1960 | Ganton | 50/370 |
| 3,732,653 | 5/1973 | Pickett | 52/71 |
| 3,832,817 | 9/1974 | Martens | 52/583 |
| 4,006,570 | 2/1977 | Stolz | 52/432 |
| 4,015,383 | 4/1977 | Crowley | 52/259 X |
| 4,019,293 | 4/1977 | Armas | 52/79 |
| 4,050,254 | 9/1977 | Meheen et al. | 61/39 |
| 4,111,401 | 9/1978 | Pickett | 256/13 |
| 4,193,584 | 3/1980 | Wieser | 256/19 |
| 4,214,411 | 7/1980 | Pickett | 52/144 |
| 4,314,431 | 2/1982 | Rabassa | 52/259 |
| 4,494,892 | 1/1985 | Wojciechowski | 404/6 |
| 4,529,174 | 7/1985 | Pickett | 256/27 |
| 4,553,875 | 11/1985 | Casey | 404/6 |
| 4,558,850 | 12/1985 | Melfi | 256/24 |
| 4,605,336 | 8/1986 | Slaw, Sr. | 404/6 |
| 4,772,155 | 9/1988 | Dimitz | 404/6 |
| 4,806,044 | 2/1989 | Duckett | 404/6 |
| 4,917,543 | 4/1990 | Cole et al. | 405/262 |
| 4,957,395 | 9/1990 | Nelson | 405/287 |
| 4,964,750 | 10/1990 | House et al. | 404/6 |
| 5,131,786 | 7/1992 | House et al. | 404/6 |
| 5,471,811 | 12/1995 | House et al. | 52/745.1 |

*Primary Examiner*—Stephen J. Novosad
*Assistant Examiner*—Tara L. Mayo
*Attorney, Agent, or Firm*—Gunn, Lee & Miller, P.C.

[57] ABSTRACT

This invention relates to a precast concrete wall consisting of a plurality of precast concrete, retaining wall segments used as a retaining wall, used to buttress against earth forces, used to abate noises, and a method of constructing such a wall. The wall can be economically constructed from the precast wall segments which are adapted to be easily and rapidly stacked and joined in series to save on the cost of labor and materials. Each of the wall segments is capable of being varied in height, width or length, but having a generally similar cross-section. The wall segments also have members which form a stay-in-place form when two wall segments are placed end to end. Cast-in-place concrete is poured into the form and, upon hardening, becomes an integral structural support column for the wall.

18 Claims, 6 Drawing Sheets

COMBINATION RETAINING WALL AND METHOD OF CONSTRUCTION

CROSS-REFERENCES TO RELATED APPLICATIONS

This is a continuation-in-part of application Ser. No. 07/917,841 filed Jul. 21, 1992, now U.S. Pat. No. 5,471,811 which was a continuation-in-part of both: application Ser. No. 07/601,413 filed Oct. 22, 1990, now U.S. Pat. No. 5,131,786, which was a continuation-in-part of application Ser. No. 07/347,482 filed May 4, 1989, now U.S. Pat. No. 4,964,750; and application Ser. No. 07/675,503 filed Mar. 26, 1991, now abandoned.

BACKGROUND OF THE INVENTION

1. Field of the Invention

Applicant's invention relates to precast barrier systems and a method of construction. More specifically, the present invention relates to a precast retaining wall with precast concrete columns and panels, and a method of constructing such a wall on a foundation surface.

2. Description of the Prior Art

In recent years, many civil engineering construction projects have used concrete barriers in numerous different applications; such as a retaining wall or as a barrier to keep out intruding people, animals, vehicles, fire, wind, light, sound, heat and the like. For a concrete barrier to be selected for these different applications, the overall cost of the barrier must be lower when considering the manufacturing costs, manpower costs and construction, and the time required to construct the wall. The barrier must also be durable and maintenance free with the possibility of a wide variety of aesthetically pleasing surface finishing. Cast-in-place concrete has given way to the use of precast concrete barriers. Precast concrete barriers are preferred because they can be manufactured at a lower cost with a higher degree of uniformity not found in cast-in-place concrete barriers. The precast concrete barriers may also be erected in numerous configurations and are capable of self support without massive construction.

Another cost which must be considered in many municipal areas is the availability of costs of purchasing right-of-ways for the construction projects. Consideration of the right-of-way requirements is particularly important in highway construction near residential areas. If the roadway is constructed near the residences, then the noise from passing vehicles and the impact of the noise on nearby residences must be considered. Ideally, the highway would be built far enough away from the residences so that the noise would not bother the residents. However, due to a continued growth of urban sprawl and the need for more highways, many times there is just not enough land available. In these situations, sound abatement walls are constructed to minimize the noise reaching the residents. Unfortunately, many of the current barrier designs require more right-of-way land than that which is available.

The need to reduce right-of-way requirements and the need to reduce costs has created a need for an environmental barrier system in which the width of barrier construction is small and which may be straight, curved, angled, or which may follow a terrain of any contour. The straighter and narrower the barrier construction, the lower the overall construction costs since less land must be acquired.

Current column and panel barriers experience a variety of problems. One problem associated with column and panel barriers is the need to very precisely position adjacent columns if prefabricated panels are to be positioned in between. The positioning problem includes not only the column-to-column spacing but also the plumbness of the column, both to the wall face and the panel ridge. Once the panel dimensions arc selected, then the panels are fabricated, and the spacing between adjacent columns must correspond to the paneling for the full exposed length of the column. If precise column positioning is not maintained, then the panels will not fit between columns which are spaced too close, or the panels cannot be attached to columns which are spaced too far apart.

In typical precast concrete construction, tolerances of plus or minus one-quarter inch or more are common, depending upon the fabricators' experience and the cost of forms. Accumulation of such tolerances require that positioning and placement of columns be very precise in order to accommodate the precast panels there between. Precise tolerances on the lateral spacing between columns can be very difficult to maintain at construction sites. Consequently, accumulation of tolerances can lead to a loose joint between panels and columns. With a loose joint, vibration can occur and sounds and the like and other forces or energy can pass through the barrier. The present invention overcomes the problems with precise tolerances without any significant additional costs.

Another problem associated with column and panel barriers concerns thermally induced, linear expansion and contraction of the completed barrier. Thermal variations in the wall can lead to loose joints during contraction as discussed above, structural damage of columns and panels due to compressive stress developed during expansion, and construction difficulty when large thermal variations occur during construction. Thus, there is a need for a precast concrete barrier which overcomes problems of the type discussed above for column and panel barriers.

SUMMARY OF THE INVENTION

The present invention overcomes problems of the type discussed above by providing a precast concrete wall comprising a plurality of precast C-shaped wall segments with U-shaped members which when placed adjacent to another C-shaped wall segment forms a stay-in-place form for a structural column. Cast-in-place concrete is poured into the column and hardens and becomes an integral structural support column for the wall. The C-shaped wall segments have a panel to spread the force of impacting vehicles, to buttress against earth forces, and to abate noises. The precast concrete wall can be economically constructed from precast concrete elements which are adapted to be easily and rapidly stacked and joined in series to save on the cost of labor and materials. Expansion joints between the wall and the foundation allow the wall to move without damaging the structural support columns.

It is an object of the present invention to provide an efficient method of constructing a wall without the need for separate structural support columns.

Another object of the present invention is to provide a barrier which can withstand thermal variations without damaging the structural integrity of the barrier.

A further object of the present invention is to provide a barrier which can be constructed with reduced labor, material, and right-of-way costs.

Additional advantages, objects, and uses will be apparent from the description for those familiar with the relevant art.

The foregoing objectives are achieved in a precast C-shaped wall segment in accordance with the present invention.

DETAILED DESCRIPTION OF THE PREFERRED EMBODIMENT

Applicants incorporate by reference, as if rewritten herein in their entirety, the entire disclosures of application Ser. No. 07/917,841 filed Jul. 21, 1992, which was a continuation-in-part of both: application Ser. No. 07/601,413 filed Oct. 22, 1990, now U.S. Pat. No. 5,131,786, which was a continuation-in-part of application Ser. No. 07/347,482 filed May 4, 1989, now U.S. Pat. No. 4,964,750; and application Ser. No. 07/675,503 filed Mar. 26, 1991, now abandoned.

Figure 1:
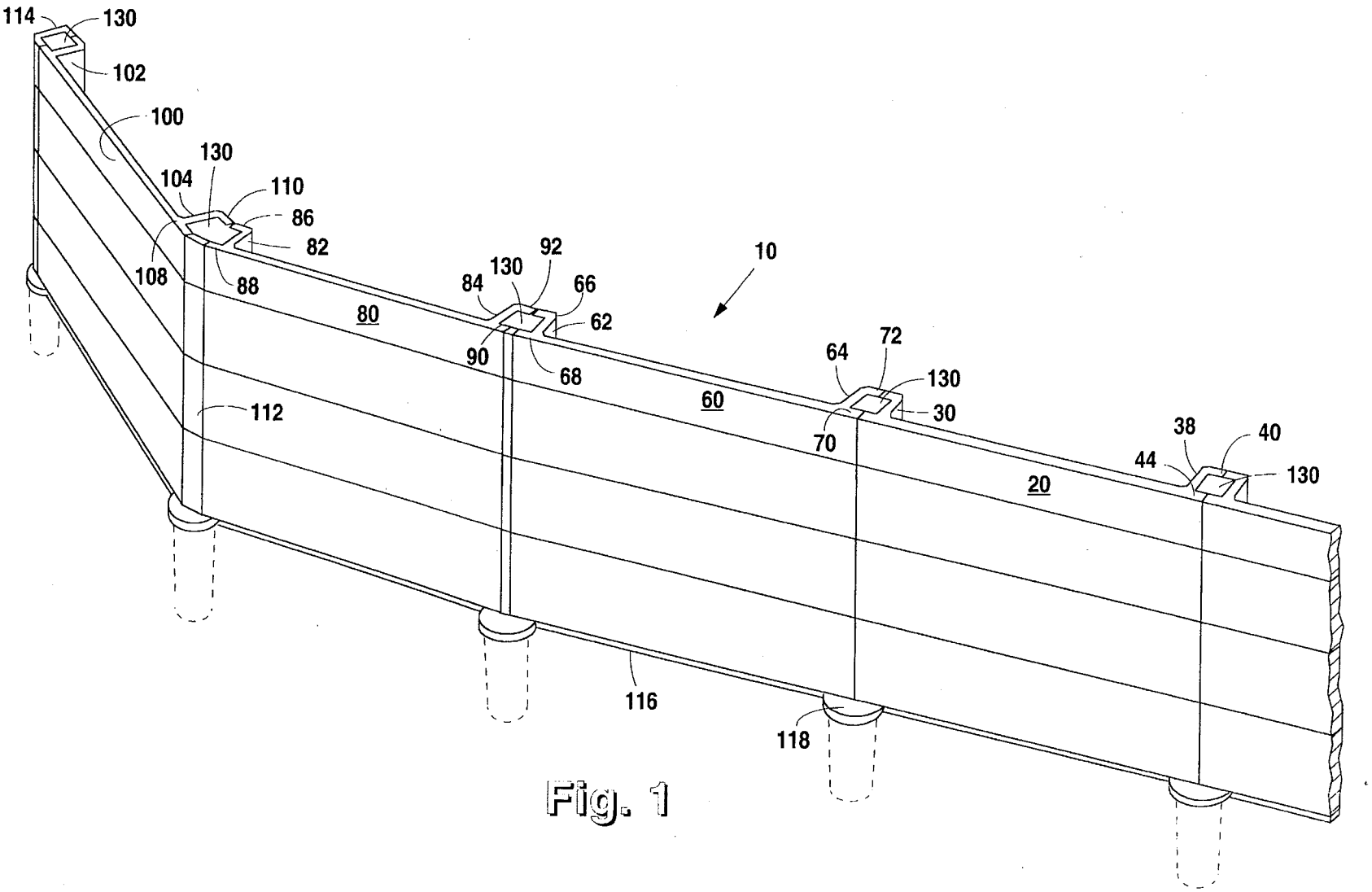
FIG. 1 is a perspective view of a wall comprising a plurality of C-shaped wall segments, in accordance with this disclosure.

The preferred embodiment of the present invention is illustrated in FIG. 1. The wall (10) may be used in numerous situations where it is desirous to keep two areas separated; such as an attractive earth retaining wall or traffic barrier for roadways. It may also be used as a sound abatement wall, a security wall, a sea wall, or a free standing temporary wall. The height of the wall may be varied to meet the specific requirements of its intended use by stacking individual segments. The wall may be constructed out of any formidable material such as fiberglass, plastic, steel, galvanized iron, reformed shredded plastic, concrete, or other materials having suitable hardness and durability properties.

In the preferred embodiment, the wall (10) is comprised of a plurality of precast, reinforced concrete, C-shaped wall segments. The wall segments may be post-tensioned. The wall may be adapted to be in a straight line or in a curve to meet the specific geographic requirements of the location.

Figure 2:
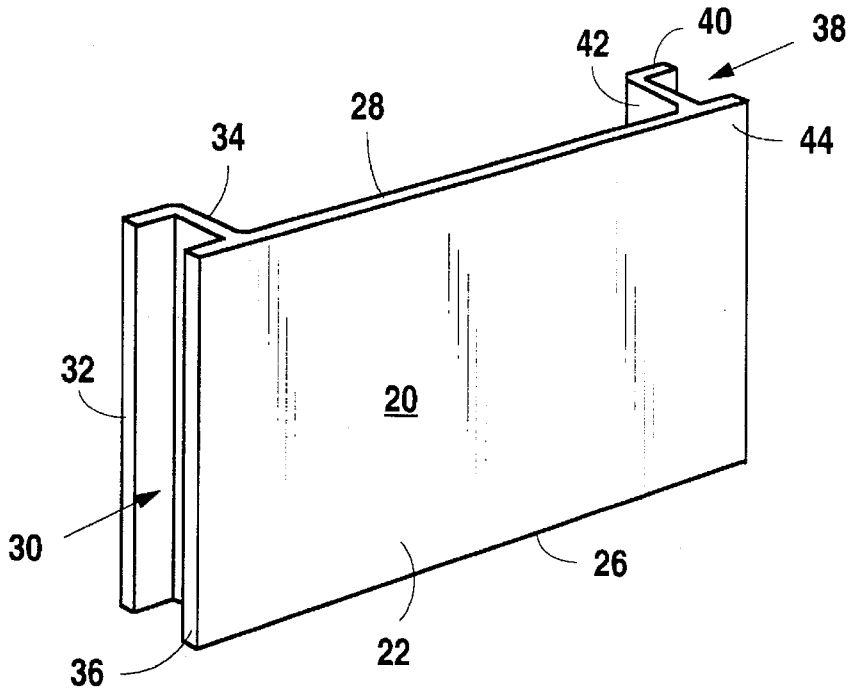
FIG. 2 is a perspective view of a C-shaped wall segment in accordance with this disclosure.

As shown in FIG. 2, each C-shaped wall segment (20) has a vertically disposed panel (22), a bottom horizontal surface (26), a top horizontal surface (28), and vertically extending U-shaped members (30, 38). U-shaped members (30, 38) are horizontally disposed at opposite ends of the panel (22) and projecting rearwardly therefrom. Bottom horizontal surface (26) is adapted for direct contact with either the ground, foundation, or stacked wall segment. The vertically disposed panel (22) is located in a horizontal plane which is described by the front leg (36) of U-shaped member (30) to the front leg (44) of U-shaped member (38).

The wall segment (20) normally has a length of about ten feet, but can vary from four feet to forty feet depending upon the specific requirements of the job. The wall segment (20) has an average normal height of ten feet, but may be adapted to any engineered height. In most uses, the wall segment will vary from three feet to thirty feet depending upon the specific requirements of the job.

Figure 5:
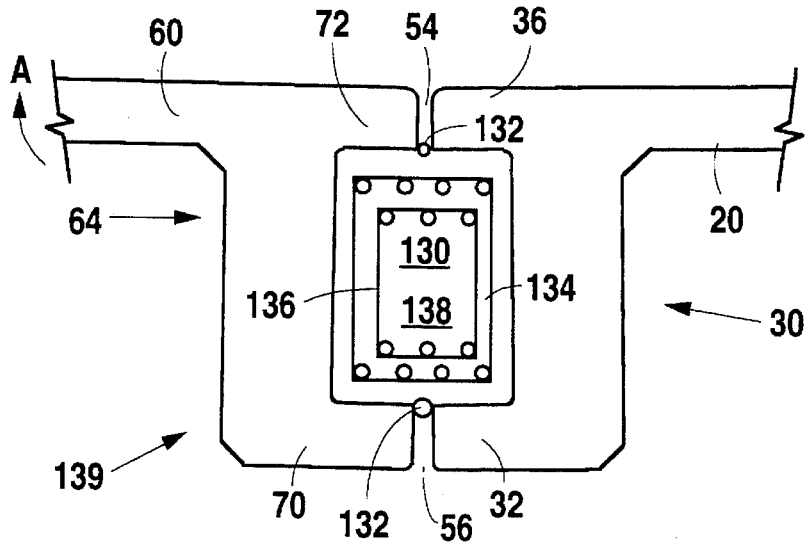
FIG. 5 is a top plan view of a column for a relatively small degree of angle of curvature of the wall in FIG. 1.
Figure 6:
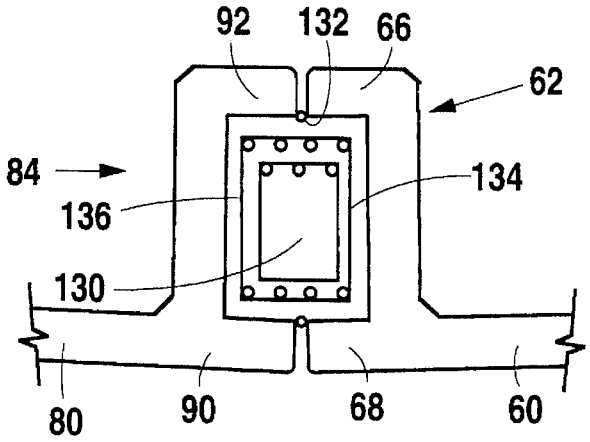
FIG. 6 is a top plan view of a column for a small degree of angle of curvature of the wall in FIG. 1.
Figure 7:
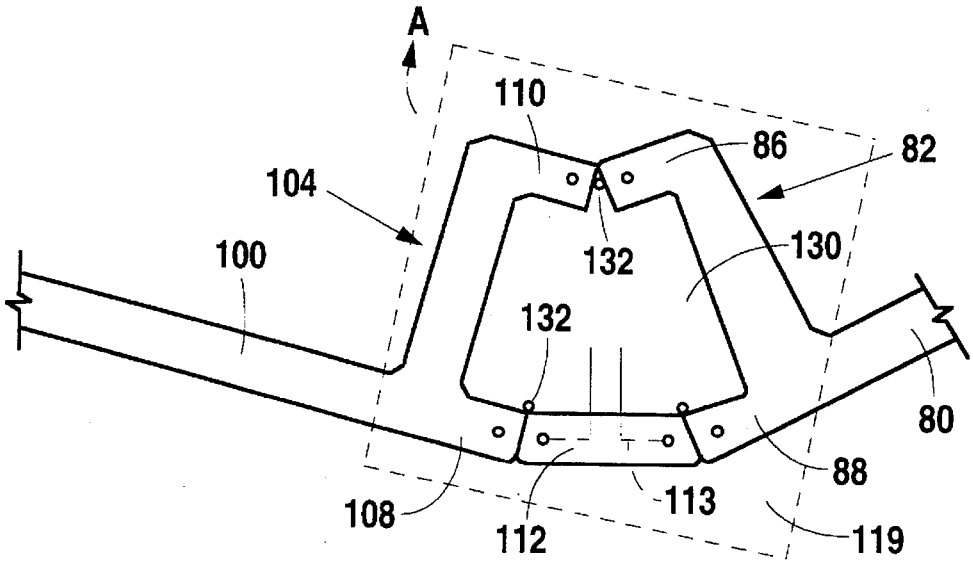
FIG. 7 is a top plan view of a column for a large degree of angle of curvature of the wall in FIG. 1.

The U-shaped members (30, 38) have a bottom (34, 42, respectively) and two legs (32, 36 and 40, 44, respectively). If the wall is to be constructed in a straight line, then the U-shaped members are precast with the sides having the same length. If the wall (10) requires a curvature, then U-shaped members may be precast with their sides having different lengths as shown in FIG. 6. Some curvature is possible in the wall (10) during construction by placement adjustments or by adding inserts as illustrated in FIGS. 5, 6 and 7, respectively.

The C-shaped wall segment (20) may be adapted to meet the specific load requirements of its use. The amount and strength of the embedded grid of vertical and horizontal reinforcement bars (not shown) may be varied. The thickness of the wall segment (20) may also be varied to meet specific requirements. If the wall segment (20) is to be used as a traffic barrier or in the bottom row of stacked wall segments, then the wall segment (20) may be precast with a thickness of 4 inches to 124 inches, although in the preferred embodiment it will be 8 inches thick with three-quarters of an inch exposed aggregate or other required surface material on the exposed face of the panel (20). The thickness of the wall segment (20) has no upper limit as the U-shaped members (30, 38) would also expand. The wall segments (20) are also easily transportable over existing roadways and railways.

Figure 3:
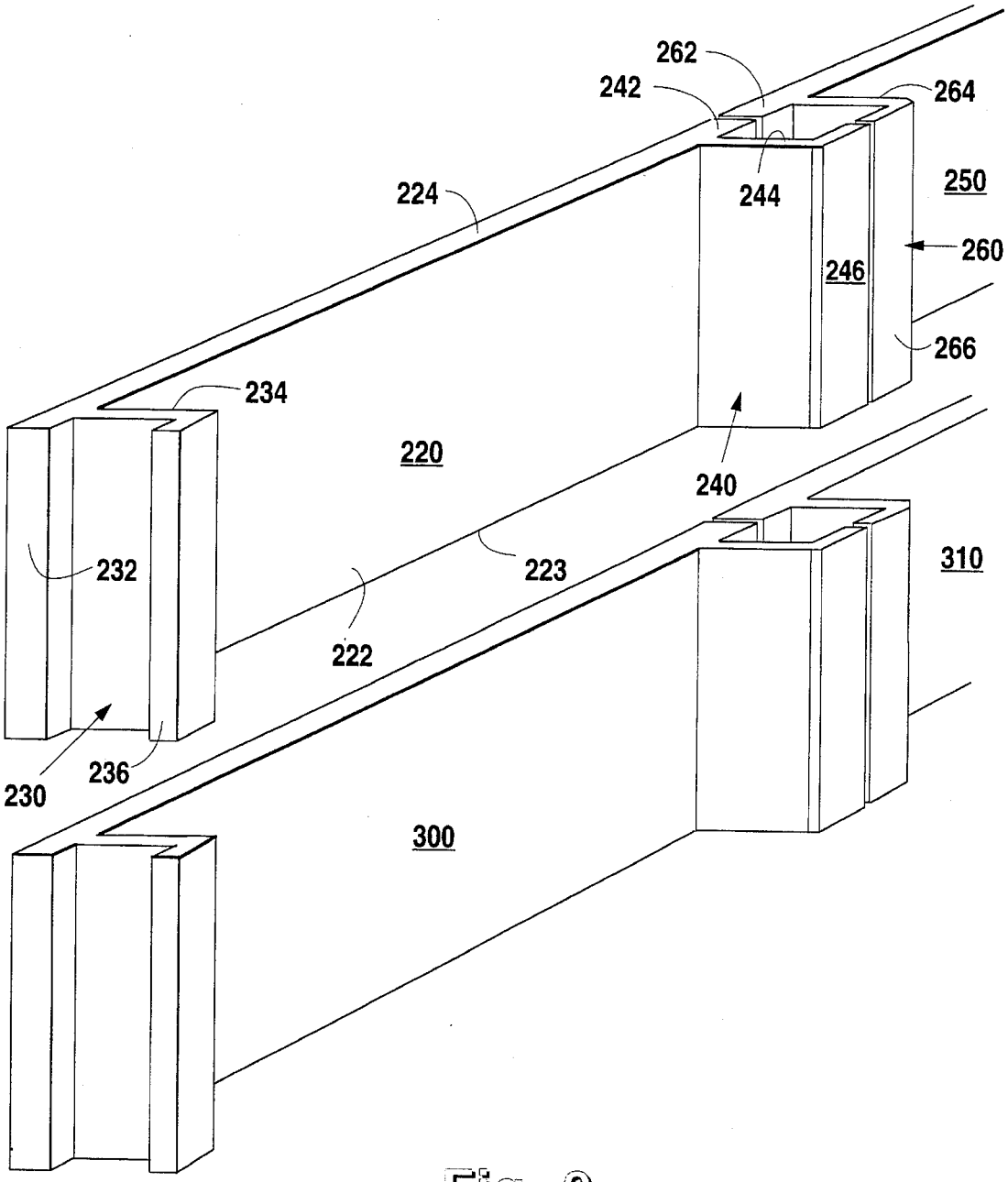
FIG. 3 is an expanded perspective view of a wall consisting of C-shaped wall segments constructed in accordance with this disclosure.
Figure 4:
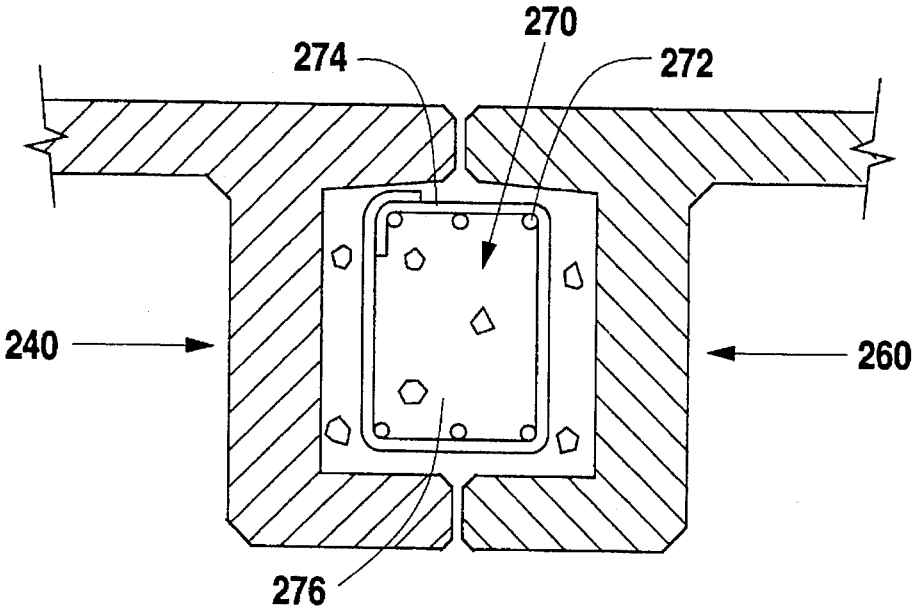
FIG. 4 is a top plan view of a structural support column for the C-shaped wall segments of the wall in FIG. 1.
Figure 8:
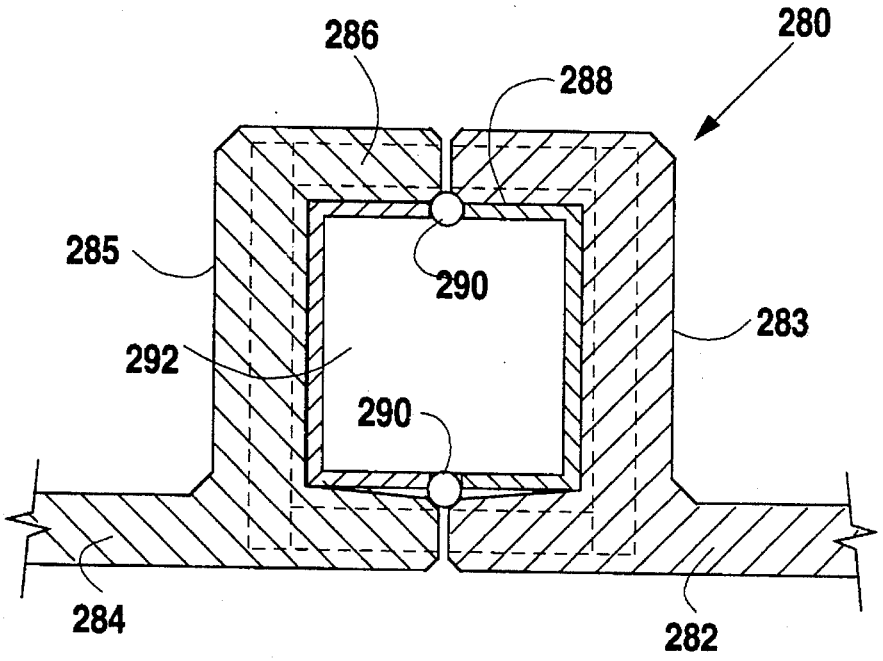
FIG. 8 is a top plan view of an expansion joint column for the wall constructed in accordance with this disclosure.

An expanded perspective view of a portion of a wall with only two rows of stacked wall segments (220, 250 and 300, 310) is shown in FIGS. 3, 4 and 8. The C-shaped wall segment (220) is stable and self-supporting. When viewed from above wall segment (220) has a C-shaped configuration. The C-shape of wall segment (220) allows easier and quicker construction of a retaining wall because the contractor can stand upright a plurality of segments on-site in preparation for placement in the retaining wall. The wall segments will then be easily and quickly moved into place and stacked upon one another. The faster construction process allows the contractor to save on the cost of labor and materials. An inventive aspect of the preferred embodiment is that wall segment (220) is capable of being a free standing structure that relies on no other means of support other than that derived from its own stability.

Each C-shaped wall segment (220) has a vertically disposed panel (222), a bottom horizontal surface (223), a top horizontal surface (224), and vertically extending U-shaped members (230, 240). U-shaped members (230, 240) have a bottom (234, 244, respectively) and two legs (232, 236 and 242, 246 respectively). U-shaped member (260) of wall segment (250) has a bottom (264) and two legs (262, 266). The vertically disposed panel (222) is located in a horizontal plane which is described by the front leg (232) of U-shaped member (230) to the front leg (242) of U-shaped member (240).

The construction time is also reduced because when wall segments (220, 250) are placed adjacent to one another, as shown in FIGS. 3 and 4, their respective U-shaped members (240, 260) define four faces of a stay-in-place form for a structural column (270). Reinforcing rods (272) are attached to a drill pier in the foundation (not shown) and extend upwards a sufficient height to reinforce the column (270) and wall. Reinforcing material (274) may also be added to the column (270) for more reinforcement of the column (270). Cast-in-place concrete (276) is poured into the stay-in-place form encasing the reinforcing rods and material creating structural column (270). The hardened concrete (276) and rods (272) couple column (270) to the drill pier.

Another inventive aspect of the preferred embodiment is that column (270) ensures proper alignment between wall segments. This eliminates a common problem found in current column and panel walls. Current walls have imprecise lateral placement of panels due to accumulated variances in the panels and placement of the columns. Much construction time is wasted as contractors have to modify or add material to the panels or columns to obtain proper placement. If the placement is bad enough, then the columns may have to be re-built.

To support column (270) in its vertically upstanding position, any one of a multitude of suitable conventional supports may be used which would allow a round cage to extend from the support through the column. It is expected that either a drill shaft, a drill pier, cast-in-place spread footing, a caisson, or a steel piling encased in concrete may be used. If the ground underneath the column is hard and stable, then a ground anchor could even be used.

Thermally induced expansion and contraction of wall segment (220) may lead to cracking of the panel (222) unless some arrangement is established to relieve thermally induced expansions and contractions. Cracking can also be created by external forces applied to the barrier, such as wind forces, impact forces from vehicles, lifting or sinking forces from ground swell or collapse, and the like. The present invention uses an expansion joint column as illustrated in FIG. 8 as one method of relieving the thermally induced internal forces and external forces.

Expansion joint column (280) is formed by wall segment (282) being placed adjacent to wall segment (284). U-shaped members (283, 285) are placed adjacent to each other and over a drill pier or other support (not shown) and define the four faces of the stay-in-place form for expansion joint (280). Sufficient reinforcing steel (not shown) is inserted in the stay-in-place form to meet the design specifications. Cushioning material (286) is placed between U-shaped members (283, 285) and the support. Padding material (288) is placed on the inside of the stay-in-place form. Any material with sufficient padding and cushioning properties could be used as material (286, 288). However, in the preferred embodiment neoprene is used as cushioning material (286) and fiberboard is used as padding material (288). Seals (290) are placed between U-shaped members (283, 285). Cast-in-place concrete (292) is then poured into the stay-in-place form. Depending on the expected internal and external forces expansion joint column (280) could be used in place of column (270). In most situations, expansion joint columns will be used approximately every 100 feet of the retaining wall to provide for sufficient expansion and contraction of the barrier without cracking.

In certain situations, the wall will be constructed where it must follow the curve of the roadway or embankment being reinforced. FIG. 1 illustrates wall (10) being used as a wall in a straight line which gently curves in a clockwise direction. Wall (10) can be adapted to curve counter-clockwise or any other non-straight line to meet the needs of each particular job.

FIG. 5 illustrates construction of the wall if the desired angle of curve is relatively small, about 1° or less. Normally, gaps (54, 56) are the same, about three-quarters of an inch. When a relatively small degree of curve is required, the U-shaped members (30, 64) of wall segments (20, 60) are placed adjacent to each other so that the gap between one set of legs is less than the other set of legs, depending on the direction of curvature. For a clockwise curve (A), gap (54) between legs (72, 36) is less than gap (56) between legs (70, 32). This will result in a curvature of about 1° to the right when wall (10) is viewed from above. Seals (132) are placed in gaps (54, 56) to prevent cast-in-place concrete (138) from leaking out of stay-in-place form (139) prior to hardening.

FIG. 6 illustrates construction of the wall if the desired angle of curve is small, between about 1° and 10°. To obtain a small angle of curve, U-shaped members (62, 84) of panels (60, 80) are precast with different length legs. The legs may have an interior length which varies from 1 inch to 100 inches and an exterior length which varies from 2 inches to 120 inches. In the preferred embodiment, the legs are 7-½ inches long for the interior length and an exterior length which slopes from 13 inches to fourteen and ⅜ inches. To achieve a clockwise small angle of curve (A), leg (90) of wall segment (80) is precast longer than leg (92). Depending on the required angle, legs (90, 92) may vary as much as 24 inches in length. In the preferred embodiment, leg (90) will be about 3 inches longer than leg (92) to obtain a 10° angle of curve. Wall segment (60) has legs (66, 68) which are of the same length. If a counter-clockwise angle of curve is desired then leg (66) would be precast longer than leg (68) and legs (90, 92) would be precast the same length.

FIG. 7 illustrates construction of the wall if the desired angle of curve is large, greater than about 10°. In this situation, legs (86, 88) of U-shaped member (82) of wall segment (80) and legs (108, 110) of U-shaped member (104) of wall segment (100) are all of the same length. Precast spacer (112) with tic back rods (113) is inserted between legs (88, 108). The tie back rods keep spacer (112) in place while the cast-in-place concrete hardens. Another embodiment of the present invention uses a wedge shaped spacer (112) which has its wider face on the interior of the stay-in-place form. The adjoining legs are cast to complement the wedge design. Therefore, the pressure of the cast-in-place concrete actually presses the spacer against the adjoining legs ensuring that the spacer remains in place while the cast-in-place concrete hardens.

The length of spacer (112) can vary from 1 inch to 100 inches depending upon the required amount of clockwise curvature (A). Curvature (A) can be as great as 90° with spacer (112), if larger degrees of curvature is desired then spacer (112) could be modified and be precast in a curve. If a counter-clockwise curve is desired, then spacer (112) would be placed between legs (86, 110). Due to the larger column (130), support (118) could be expanded to properly support the column with spread footing (119).

FIGS. 5, 6, and 7 illustrate the independent use of varied gaps, varied length of legs, and a spacer. In actual use, all three methods could be used in any combination, or all at once, to adapt the wall to the specific requirements of the job.

As seen in FIG. 1, when wall (10) terminates, closure piece (114) is used to finish wall (10) in an aesthetically pleasing look. Closure piece (114) is U-shaped and is adapted to be placed adjacent to the U-shaped member (102) of the adjoining wall segment. The closure piece (114) and adjoining U-shaped member (102) create the stay-in-place form for column (130). Reinforcing bar extends from within closure piece (114) into the column (130) keeping closure piece (114) in its proper location once the cast-in-place concrete hardens. Sufficient reinforcing steel to adapt the closure piece to the design is also inserted in column (130) when the column is located at the end of wall (10).

Figure 9:
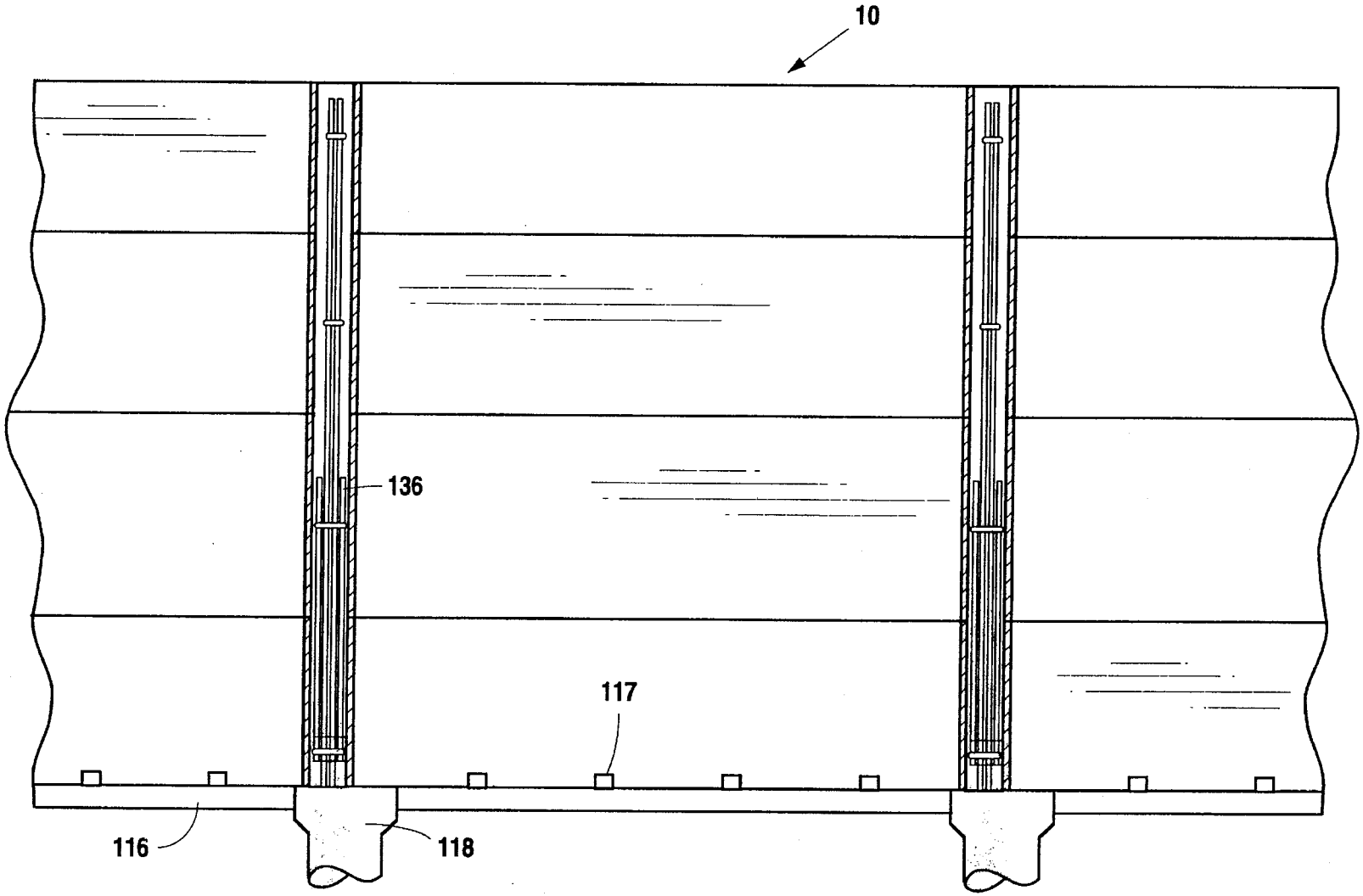
FIG. 9 is a cross sectional view of a portion of the wall in FIG. 1.

If the design requirements for the location of wall (10) require fluid flow from one side of the wall segment to the other side, then drains (117) may be added as illustrated in FIG. 9. Drains (117) are precast in the wall segments. The amount of expected fluid flow will determine the number and size of drains (117).

FIG. 9 shows that wall (10) rests on, and is supported by, foundation or base (116) and drill pier or support (118). Foundation is built prior to the placement of the panels. The foundation can be made of any material having the necessary stability, strength, and durability properties including, but not limited to, concrete, crushed limestone, pea gravel, and the like. In some locations, the ground may be flat, stable, and solid enough so that the panel may rest directly on the ground. When resting directly on the ground, the reinforcing steel for the columns may be driven into the ground or be anchored by ground anchors including, but limited to, Dywidag anchors and the like.

If two rows of panels are used in the barrier, then reinforcing steel (134) may extend into both the bottom row of panels and second row of panels. In some situations reinforcing steel (134) may extend only into the bottom row of panels and reinforcing steel (136) extends from the bottom row of panels into the second. If more rows of panels are stacked, then the reinforcing steel is spliced into the lower levels to obtain the required strength and support for barrier (10).

Construction of the wall starts with a detailed analysis of the site and any special design requirements of the wall. The C-shaped wall segments are adapted to meet the specific requirements such as: drains, extra reinforcement of the bottom wall segments where potential for vehicle impact exists, conduits in the wall segments for running electrical cables for lights or other applications, and precasting the wall segments to adapt to the curvature of the location. The panels are then easily transported over existing highways and railways to the site location and placed in the vicinity of their final placement in the wall.

Any one of a multitude of suitable conventional foundations and supports may be used to support the C-shaped wall segments. For example, FIG. 1 illustrates drill piers (118) may be used to support the columns and a concrete base (116) may be used to support the panels themselves. The specifics for the foundation for the wall (10) is determined by the job site subsurface soil conditions and the use of the barrier. Factors which should be considered in determining specific foundation include, but are not limited to, thermal expansion, thermal contraction, broadside force, longitudinal force, weight from the barrier, frost heave, impact force, wind force, ground elevation, and soil stability.

A graded concrete foundation is constructed in the direction of the wall. If a stable surface exists, the foundation could be just the ground. In most normal applications, the foundation is constructed for support of the wall with a base and plurality of drill piers of sufficient depth for withstanding expected overturning and destructive forces which may be applied to the wall. The drill piers should be substantially lined with adjacent drill piers having a distance separating them which is substantially the same distance as the length of a wall segment. The depth of the drill piers may vary depending upon analysis of the above factors. Reinforcing material is placed through said drill pier extending upwards a sufficient height for reinforcing the wall. If leveling of the area around the drill pier is required, a cast rip-rap leveling pad may be poured around the drill pier.

A first precast C-shaped wall segment is positioned over the foundation so that it is aligned with a top surface of the foundation. Once aligned, the first precast C-shaped wall segment is lowered so that the C-shaped wall segment engages the top surface of the foundation by lengthwise contact thereagainst in a stacked relationship. The bottom surface and U-shaped members of the first precast C-shaped wall segment supports the wall segment in an upright position.

A second precast C-shaped wall segment is placed adjacent to the first precast C-shaped wall segment so that the U-shaped member of the second wall segment is removably coupled with the U-shaped member of the first wall segment, and defining the four faces of a stay-in-place form. The form surrounds the reinforcing material extending upward from the drill pier. The outer faces of the C-shaped wall segments form the relatively flat vertical outer face of the retaining wall. Shims may be used to assure that the wall segments are level and plumb.

After the stay-in-place form is formed, cast-in-place concrete is poured into the form in filling the drill pier and encasing the reinforcing material. An inventive aspect of the present disclosure is that the cast-in-place concrete can be poured into the stay-in-place form at any time after two C-shaped wall segments are placed adjacent to each other. In this manner, the columns can all be poured at one time when the entire wall has been aligned, or after each form is constructed, or when several forms are constructed.

After the cast-in-place concrete has reached its required strength in the stay-in-place form, the preceding steps could be repeated to the required height of the barrier so that a second row of C-shaped wall segments may be stacked on top of one another. If conditions allow, two C-shaped wall segments may be stacked on one another before pouring the cast-in-place concrete. Spliced vertical reinforcing bars may be inserted in the form as required for taller barriers. This splicing should be completed before setting of the upper C-shaped wall segments.

Although the invention has been described with reference to specific embodiments, this description is not meant to be construed in a limiting sense. Various modifications of the disclosed embodiments, as well as alternative embodiments of the invention, will become apparent to persons skilled in the art upon reference to the description of this invention. It is, therefore, contemplated that the appended claims will cover such modifications as fall within the true scope of the invention.

We claim:

1. A precast concrete wall capable of being rapidly and efficiently constructed and capable of withstanding nominally applied overturning and destructive forces comprising:

a. a plurality of C-shaped wall segments wherein said C-shaped wall segments have a generally similar C-shaped cross-section, each C-shaped wall segment comprising:

i. a vertically arranged precast concrete panel having a thickness, a height, and a first generally vertical edge and a second generally vertical edge;

ii. a first generally vertically disposed U-shaped member and a second generally vertically disposed U-shaped member, each said first and said second U-shaped member having a front leg and a rear leg, and a thickness and a height substantially similar to said thickness and said height of said panel, each said first and said second U-shaped members horizontally located at opposite ends of said panel;

iii. said panel located in a horizontal plane from said front leg of said first U-shaped member to said front leg of said second U-shaped member;

b. said first U-shaped member of a first C-shaped wall segment adapted to be located adjacent to said second U-shaped member of a second C-shaped wall segment for forming a stay-in-place form for casting a structural support column on-site, said structural support column securing said first C-shaped wall segment to said second C-shaped wall segment, said stay-in-place form having a cavity extending vertically throughout substantially the entire height of said stay-in-place form;

c. means, located in said cavity of said stay-in-place form, for reinforcing said column;

d. cast-in-place concrete positioned in said cavity of said stay-in-place form and encasing said reinforcing means; and c. said stay-in-place form being a part of said column once said cast-in-place concrete hardens.

2. The invention as claimed in claim 1 wherein:

a. said first C-shaped wall segment comprises a first top surface facially engaging a superposed third C-shaped wall segment by lengthwise contact thereagainst in a stacked relationship; and b. said second C-shaped wall segment comprises a second top surface facially engaging a superposed fourth C-shaped wall segment by lengthwise contact thereagainst in a stacked relationship.

3. The invention as claimed in claim 2 wherein said panels of said first C-shaped wall segment and said second C-shaped wall segment are thicker than said panels of said third C-shaped wall segment and said fourth C-shaped wall segment for withstanding nominally applied overturning and destructive forces.

4. The invention as claimed in claim 1 wherein:

a. said front leg of said first U-shaped member of said first C-shaped wall segment is longer in length than said rear leg of said first U-shaped member of said first C-shaped wall segment;

b. said front leg of said second U-shaped member of said second C-shaped wall segment is the same length as said rear leg of said second U-shaped member of said second C-shaped wall segment;

c. said first U-shaped member adapted to be located adjacent to said second U-shaped member for constructing said wall with a desired angle of curvature.

5. The invention as claimed in claim 1 further comprising a spacer adapted for placement between said first U-shaped member of said first C-shaped wall segment and said second U-shaped member of said second C-shaped wall segment for constructing said wall with a desired angle of curvature.

6. The invention as claimed in claim 1 further comprising means for allowing expansion of each said C-shaped wall segment for resisting cracking of each said C-shaped wall segment from nominally applied forces.

7. A method of constructing a precast concrete wall at a job site having a right-of-way, said wall consisting of a plurality of C-shaped wall segments wherein said C-shaped wall segments have a generally similar C-shaped cross-section, each C-shaped wall segment comprising: a vertically arranged precast concrete panel having a thickness, a height, and a first generally vertical edge and a second generally vertical edge; a first generally vertically disposed U-shaped member and a second generally vertically disposed U-shaped member, each said first and said second U-shaped members having a front leg and a rear leg, and a thickness and a height substantially similar to said thickness and said height of said panel, each said first and said second U-shaped members horizontally located at opposite ends of said panel; said panel located in a horizontal plane from said front leg of said first U-shaped member to said front leg of said second U-shaped member; said first U-shaped member, said second U-shaped member, and said panel capable of overcoming ambient overturning forces exerted on said panel whereby said precast C-shaped retaining wall segment is inherently stable and capable of standing upright with no other support, wherein said method of construction comprises the steps of:

a. constructing foundation means for supporting said wall;

b. attaching reinforcing material to said foundation means and extending upwards a sufficient height for reinforcing said wall;

c. positioning a first C-shaped wall segment over said foundation means so that said first C-shaped wall segment is aligned with a top surface of said foundation means;

d. lowering said first C-shaped wall segment so that said first C-shaped wall segment engages said top surface of said foundation means by lengthwise contact thereagainst in a stacked relationship, a bottom surface of said vertically arranged panel of said first C-shaped wall segment and said first and said second U-shaped members of said first C-shaped wall segment supporting said C-shaped wall segment in an upright position;

e. placing a second C-shaped wall segment adjacent to said first C-shaped wall segment so that said second U-shaped member of said second C-shaped wall segment is removably coupled with said first U-shaped member of said first C-shaped wall segment and defining four faces of a stay-in-place form surrounding said reinforcing material extending upward from said foundation means;

f. pouring cast-in-place concrete into said stay-in-place form encasing said reinforcing material; and g. allowing said cast-in-place concrete to harden so that said stay-in-place form becomes an integral part of said first and said second C-shaped wall segments.

8. The method of construction as claimed in claim 7 further comprising the step of placing a first plurality of said first and said second C-shaped wall segments so that said C-shaped wall segments engage said top surface of said foundation means to form a first row of said first and said second C-shaped wall segments prior to pouring cast-in-place concrete in said stay-in-place form.

9. The method of construction as claimed in claim 8 further comprising the step of placing a second plurality of said first and said second C-shaped wall segments forming a second row of said first and said second C-shaped wall segments on top of said first row of said first and said second C-shaped wall segments after pouring cast-in-place concrete in said stay-in-place form.

10. The method of construction as claimed in claim 7 further comprising the steps of:

a. pouring cast-in-place concrete to construct said foundation means; and b. allowing said cast-in-place concrete of said foundation means to harden to a design strength capable of supporting said first and said second C-shaped wall segments prior to positioning said first C-shaped wall segment over said foundation means.

11. The method of construction as claimed in claim 7 further comprising the steps of:

a. placing said first and said second C-shaped wall segments adjacent to each other with a slight gap between said second U-shaped member of said first C-shaped wall segment adjacent said first U-shaped member of said second C-shaped wall segment;

b. placing a seal in said gap to keep said cast-in-place concrete from leaking out of said stay-in-place form while said cast-in-place concrete is being poured and is hardening to design strength.

12. The method of construction as claimed in claim 7 further comprising the steps of:

a. drilling a plurality of drill piers to a sufficient depth for withstanding expected overturning and destructive forces which may be applied to said wall, said drill piers substantially aligned with adjacent drill piers having a distance separating said drill piers which is substantially the same distance as said length of said first and said second C-shaped wall segments;

b. placing said reinforcing material into said drill piers and extending upwards a sufficient height for reinforcing said wall; and c. pouring cast-in-place concrete into said drill piers and encasing said reinforcing material prior to positioning said first C-shaped wall segment over said foundations means.

13. A method of constructing a precast concrete wall at a job site having a right-of-way, said wall consisting of a plurality of C-shaped wall segments wherein said C-shaped wall segments have a generally similar C-shaped cross-section, each C-shaped wall segment comprising: a vertically arranged precast concrete panel having a thickness, a height, and a first generally vertical edge and a second generally vertical edge; a first generally vertically disposed U-shaped member and a second generally vertically disposed U-shaped member, each said first and said second U-shaped members having a front leg and a rear leg, and a thickness and a height substantially similar to said thickness and said height of said panel, each said first and said second U-shaped members horizontally located at opposite ends of said panel; said panel located in a horizontal plane from said front leg of said first U-shaped member to said front leg of said second U-shaped member; said first U-shaped member, said second U-shaped member, and said panel capable of overcoming ambient overturning forces exerted on said panel whereby said precast C-shaped retaining wall segment is inherently stable and capable of standing upright with no other support, wherein said method of construction comprises the steps of:

a. constructing foundation means for supporting said wall, said foundation means having reinforcing material through said foundation means, said reinforcing material extending upwards a sufficient height for reinforcing said wall;

b. transporting said first and said second C-shaped wall segments to said job site and placing said first and said second C-shaped wall segments in the vicinity of their final placement in said wall;

c. positioning said first C-shaped wall segment over said foundation means so that said first C-shaped retaining wall is aligned with a top surface of said foundation means;

d. lowering said first C-shaped wall segment so that said first C-shaped wall segment engages said top surface of said foundation means by lengthwise contact thereagainst in a stacked relationship, a bottom surface of said vertically arranged panel of said first C-shaped wall segment and said first and said second U-shaped members of said first C-shaped wall segment support said first C-shaped wall segment's weight in an upright position overcoming ambient overturning forces;

e. placing said second C-shaped wall segment adjacent to said first C-shaped wall segment so that said second U-shaped member of said second C-shaped wall segment is removably coupled with said first U-shaped member of said first C-shaped wall segment forming a stay-in-place form surrounding said reinforcing material extending upward from said foundation means;

f. pouring cast-in-place concrete into said stay-in-place form encasing said reinforcing material; and g. allowing said cast-in-place concrete to harden so that said stay-in-place form becomes an integral part of said first and said second C-shaped wall segments.

14. The method of construction as claimed in claim 13 further comprising the step of placing a first plurality of said first and said second C-shaped wall segments so that said C-shaped wall segments engage said top surface of said foundation means to form a first row of said first and said second C-shaped wall segments prior to pouring cast-in-place concrete in said stay-in-place form.

15. The method of construction as claimed in claim 14 further comprising the step of placing a second plurality of said first and said second C-shaped wall segments forming a second row of said first and said second C-shaped wall segments on top of said first row of said first and said second C-shaped wall segments after pouring cast-in-place concrete in said stay-in-place form.

16. The method of construction as claimed in claim 13 further comprising the steps of:

a. pouring cast-in-place concrete to construct said foundation means; and b. allowing said cast-in-place concrete of said foundation means to harden to a design strength capable of supporting said first and said second C-shaped wall segments prior to positioning said first C-shaped wall segment over said foundation means.

17. The method of construction as claimed in claim 13 further comprising the steps of:

a. placing said first and said second C-shaped wall segments adjacent to each other with a slight gap between said second U-shaped member of said first C-shaped wall segment adjacent said first U-shaped member of said second C-shaped wall segment;

b. placing a seal in said gap to keep said cast-in-place concrete from leaking out of said stay-in-place form while said cast-in-place concrete is being poured and is hardening to design strength.

18. The method of construction as claimed in claim 13 wherein said step of constructing a foundation means comprises the steps of:

a. preparing a form for a base for supporting said C-shaped wall segments;

b. drilling a plurality of drill piers adjacent to said form for said base to a sufficient depth for withstanding expected overturning and destructive forces which may be applied to said wall, said drill piers substantially aligned with adjacent drill piers having a distance separating said drill piers which is substantially the same distance as said length of said first and said second C-shaped wall segments;

c. placing reinforcing material into said drill piers and extending upwards a sufficient height for reinforcing said wall; and d. pouring cast-in-place concrete into said form for said base and said drill piers and encasing said reinforcing material prior to positioning said first C-shaped wall segment over said foundations means.

* * * * *